US012582250B1

(12) United States Patent
Kammermayer

(10) Patent No.: US 12,582,250 B1
(45) Date of Patent: Mar. 24, 2026

(54) FITNESS PILLOW FOR NECK AND HEAD SUPPORT

(71) Applicant: Christian Kammermayer, Miami, FL (US)

(72) Inventor: Christian Kammermayer, Miami, FL (US)

( * ) Notice: Subject to any disclaimer, the term of this patent is extended or adjusted under 35 U.S.C. 154(b) by 231 days.

(21) Appl. No.: 18/208,400

(22) Filed: Jun. 12, 2023

(51) Int. Cl.
*A47G 9/10* (2006.01)

(52) U.S. Cl.
CPC ..... *A47G 9/1081* (2013.01); *A47G 9/1072* (2013.01); *A47G 2009/1018* (2013.01)

(58) Field of Classification Search
CPC ..... A47G 9/00; A47G 9/10; A47G 9/1081; A47G 9/1072; A47G 2009/1018
See application file for complete search history.

(56) References Cited

U.S. PATENT DOCUMENTS 4,375,112 A * 3/1983 Leonhart ..... A47G 9/10 5/639
4,473,913 A * 10/1984 Ylvisaker ..... A47G 9/10 5/632
4,513,462 A * 4/1985 Thomas ..... A47G 9/1081 5/636
4,788,728 A * 12/1988 Lake ..... A47G 9/10 5/636
5,018,231 A * 5/1991 Wang ..... A47G 9/10 5/636
5,781,947 A * 7/1998 Sramek ..... A47G 9/109 5/636
7,082,633 B1 * 8/2006 Maarbjerg ..... A47G 9/10 5/636
D707,358 S * 6/2014 Mantilla ..... A47G 9/00 D6/601
D732,312 S * 6/2015 Tiffin ..... A47G 9/00 D6/601
10,143,317 B2 12/2018 Jensen
11,559,153 B2 1/2023 Mani
2014/0020184 A1 * 1/2014 Loth ..... A47G 9/1081 5/640
2014/0359944 A1 * 12/2014 Thompson ..... A61G 13/1285 5/636

* cited by examiner

*Primary Examiner* — Fredrick C Conley
(74) *Attorney, Agent, or Firm* — Sanchelima & Associates, P.A.; Jesus Sanchelima; Christian Sanchelima

(57) ABSTRACT

The present invention is related to a fitness pillow to support the user's head and neck while exercising, stretching, meditating, or the like, on the floor. The present invention further includes a slip proof layer on the bottom side thereof. In one embodiment, the pillow has a concave top surface that may be made of a non-porous material that may be properly sealed for easy cleaning. The pillow herein disclosed is designed to support the spine by conforming to its natural shape, which can help to maintain proper spinal alignment and prevent discomfort or pain. The present invention would not collect bacteria due to the nature of its top surface, which could be whipped off with a disinfectant towel or spray.

7 Claims, 2 Drawing Sheets

FITNESS PILLOW FOR NECK AND HEAD SUPPORT

BACKGROUND OF THE INVENTION

1. Field of the Invention

The present invention relates to a pillow and, more particularly, to a fitness pillow for neck and head support with a grip surface at the bottom thereof.

2. Description of the Related Art

Several designs for pillows have been developed in the past. None of them, however, incorporate the unique features of the new fitness pillow, such as a gripping assembly comprising a non-slip layer positioned on the bottom surface to ensure stability during use, as well as a sealed non-porous top surface for easy cleaning. The existing body of knowledge in the field of pillows does not encompass these distinctive aspects.

Applicant believes that a related reference corresponds to U.S. Pat. No. 11,559,153 issued for a portable head and neck pillow support. The pillow comprises a support pillow configured to optimally support the neck and head of a user in upright, supine, or seated positions. The pillow further comprises a hole for securely supporting the occiput. Applicant believes that another related reference corresponds to U.S. Pat. No. 10,143,317 issued for cushion for supporting the head of a person. The cushion comprises a pillow portion usable for supporting the head of the user and an elongated trunk portion that extends away from the pillow portion and is usable for supporting the chin of the user. The cushion may simultaneously contact and provide support for the back of the neck of the user, a portion of the side of the head of the user between the back of their neck and their ear, and also for the chin of the user. None of these references, however, teach of a gripping assembly including a non-slip layer disposed on the said bottom surface to prevent the pillow from moving during use and the non-porous top surface sealed for cleaning. Such a device is not explicitly disclosed in the shortlisted prior art patent documents when considered singly or in combination Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide support for the head and the neck when laying down in a fitness/wellness/medical setting.

This invention aims to provide a versatile pillow primarily designed for various activities such as floor exercises, training, stretching, meditating, massages, breathing sessions, or simply resting. While these applications are emphasized, the pillow's potential uses extend beyond these examples.

It is still another object of the present invention to provide support to the neck and head in a mostly horizontal position preventing a hyper extension and uncomfortable position of the neck and head.

It is yet another key objective of the present invention to effectively support the neck and head, promoting a predominantly horizontal position that safeguards against neck and head hyperextension, thus eliminating any potential discomfort associated with such positioning.

The fitness pillow finds its application primarily in fitness facilities, wellness/physical rehab/yoga centers, medical facilities, athletic departments of universities/colleges/high schools, professional/amateur sport teams, pilates, retreats. In addition, the present invention will be a great partner for individuals in-home use.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
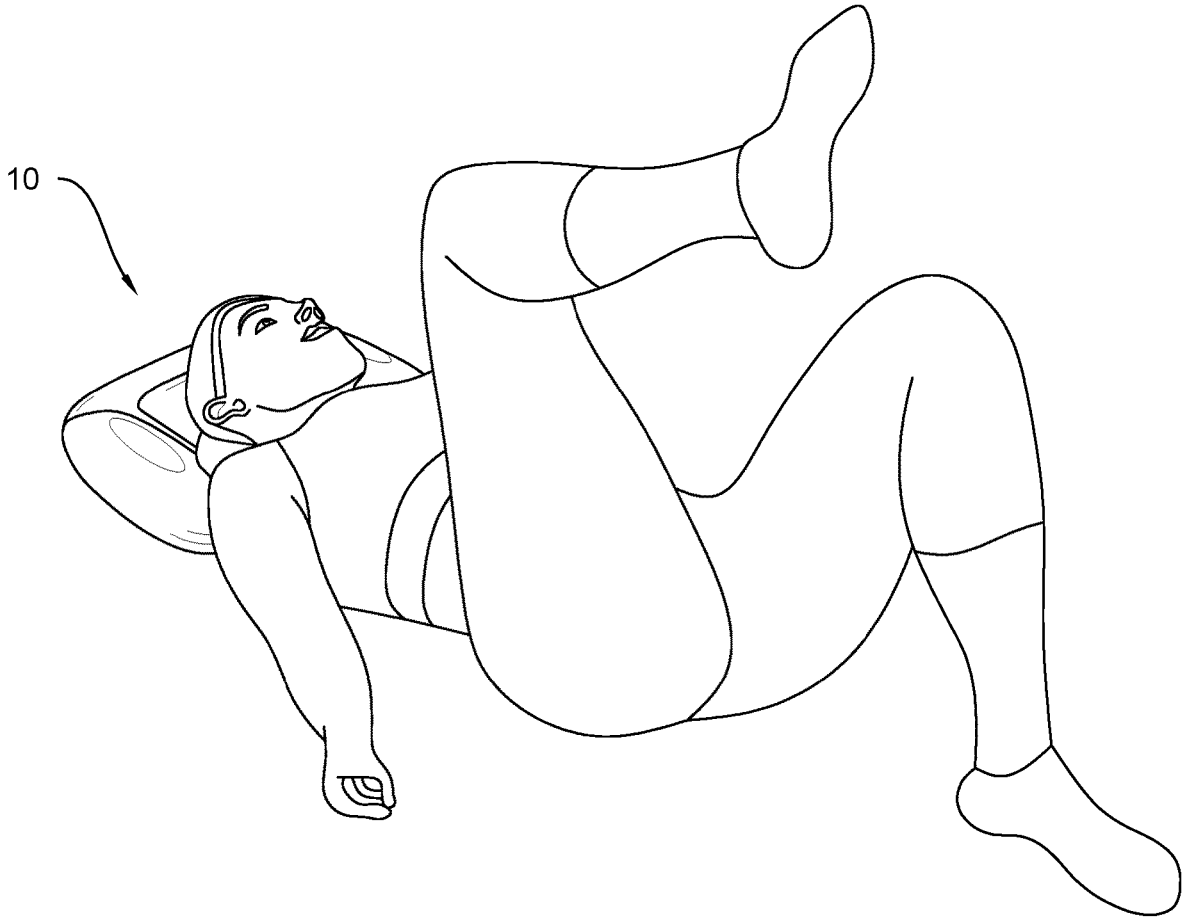
FIG. 1 represents an operational view of the present invention 10.

Referring now to the drawings, where the present invention is generally referred to with numeral 10, it can be observed that it basically includes a pillow assembly 20 and a grip assembly 40. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

Pillow assembly 20 may include a core material 22, a sealed top surface 24, an indentation 26, lateral sides 28. It should be understood that the pillow assembly 20 also termed as pillow, refers to the complete structure of the pillow, including all its aforesaid components (and suitable variations thereof) to form a functional unit.

Figure 3:
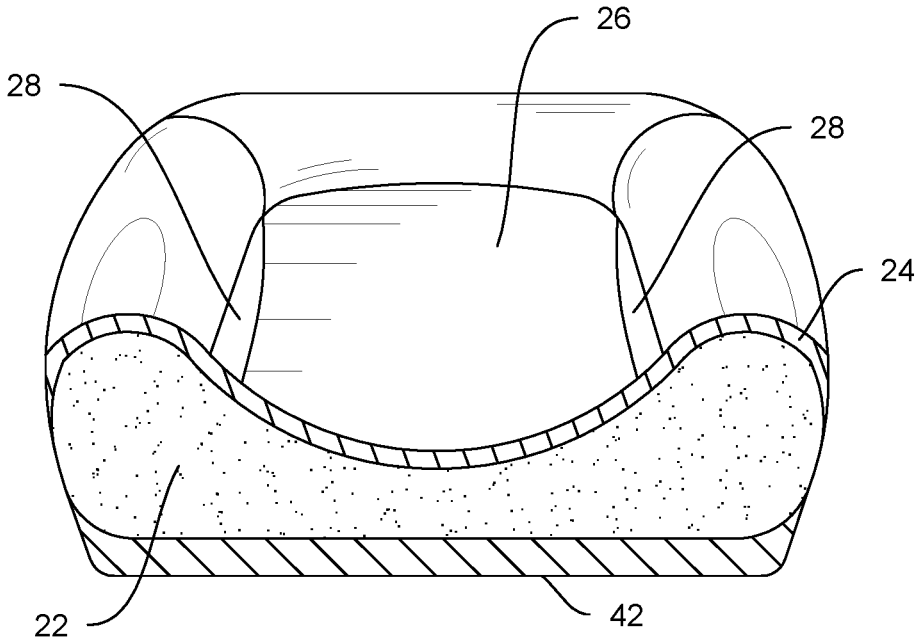
FIG. 3 is a cross section of the inner core of the pillow of the present invention along line A-A of FIG. 2.

The core material 22 may be the innermost part of the pillow assembly 20 as appreciated in FIG. 3. In various embodiments, the core material 22 may be made from substances like memory foam, latex foam, microfiber fill, natural or synthetic fibers, closed cell foam, or any other suitable material as known in the state of art. In a preferred embodiment, the core material 22 may be a high-performance, closed-cell PVC foam that is known in the art for its outstanding strength, stiffness, and lightness. It may be sought for the core material 22 to exhibit properties such as outstanding strength and stiffness to weight ratio, good impact strength, high fatigue resistance, and/or the like. It may also be suitable for the core material 22 to be composed of a combination of synthetic polymers or elastomers that are processed to form a homogeneous cellular structure. In one embodiment, AIREX® foams may be used to manufacture the core material 22.

In a preferred embodiment, the sealed top surface 24 may be non-porous and sealed, making it easy to clean. In one exemplary embodiment, an antibacterial or antimicrobial coating could be added to prevent the buildup of germs, odors, or allergens. The sealed top surface 24 of the fitness pillow is the specific portion that comes into direct contact with the user's head and neck during workouts or fitness activities. It is designed to provide a hygienic and comfortable experience, considering the pillow's fitness-oriented purpose. In another embodiment, the sealed top surface 24 may be constructed to be non-porous, featuring a tightly sealed and impermeable surface. This feature prevents sweat, oils, dirt, or other workout-related substances from seeping into the core material 22, ensuring cleanliness and maintaining the integrity of the pillow. The impermeable nature of the sealed top surface 24 prevents the absorption of sweat, which can lead to unpleasant odors or the growth of bacteria. It simplifies the cleaning process, as the surface can be easily wiped clean or sanitized without any liquid reaching the core material 22. In another embodiment, the sealed top surface 24 may provide a smooth and consistent texture, avoiding any potential discomfort or irritation that might arise from direct contact with the core material 22.

Figure 2:
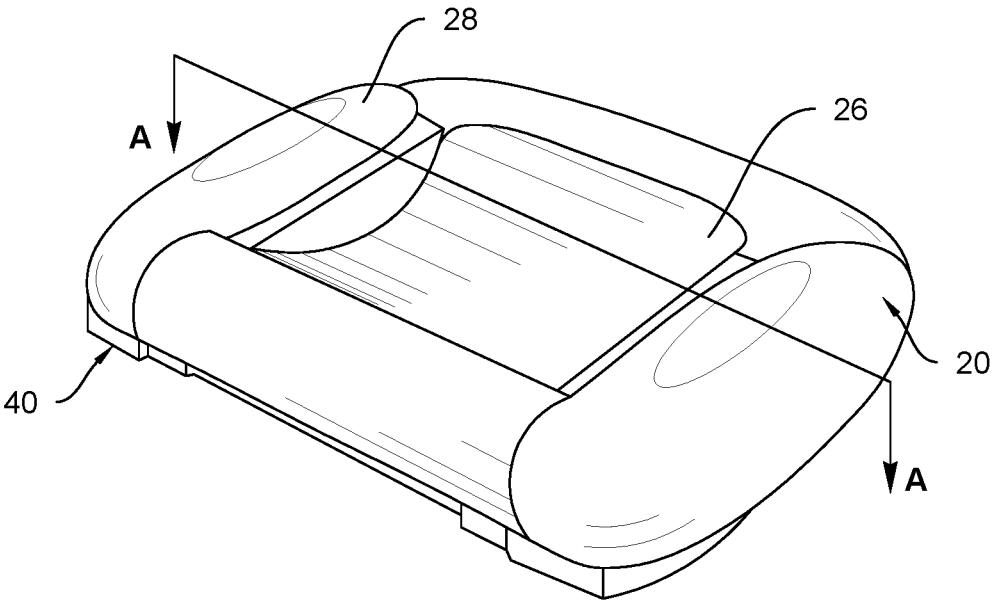
FIG. 2 shows an isometric view of the present invention in an exemplary embodiment.

Structurally-wise, the indentation 26 may be a recessed area or contour on the surface of the pillow as seen in FIG. 2. In one embodiment, the indentation 26 may be positioned to cradle and support the user's head and neck, promoting proper spinal alignment and reducing strain during fitness routines. In another embodiment, the indentation 26 may enhance stability and may prevent the head from rolling or sliding off the pillow during dynamic movements or exercises. It helps to anchor the head and neck in a secure position, allowing the user to maintain proper form and alignment throughout their fitness routine. It should be understood that the depth and shape of the indentation 26 may vary depending on the specific design of the fitness pillow, without departing from the scope of the appended claims.

The lateral sides 28 may be the edges or boundaries of the pillow assembly 20. The lateral sides 28 of the pillow assembly 20 may be designed to work in conjunction with the indentation 26, providing additional support and stability to the user's head and neck. In one embodiment, the lateral sides 28 may extend horizontally and vertically from one distal end to an opposite one, thereby encompassing the area surrounding the indentation 26. The lateral sides 28 may exhibit a predetermined height and profile that may be designed based on application requirements. It should be understood that during utilization, when the user's head and neck rest upon the indentation 26, the lateral sides 28 may extend upward, thereby partially surrounding the user's head and neck.

A grip assembly 40 may include a non slip layer 42. In a preferred embodiment, the non-slip layer 42 may cover the entire bottom surface of the pillow assembly 20. In other suitable embodiments, the non-slip layer 42 may partially cover the bottom surface of the pillow assembly 20. It should be understood that the primary function of the non-slip layer 42 may be to provide a gripping mechanism which may ensure that the pillow assembly 20 remains securely in place during exercise or fitness activities. The non-slip layer 42 may act as a friction-enhancing element, thereby creating traction and grip to maintain the pillow assembly's stability and position. In various embodiments thereof, different materials may be used to form the non-slip layer. In one embodiment, the non-slip layer 42 may be formed using rubber or silicone, which exhibit excellent grip and traction properties. In other embodiments materials such as thermoplastic elastomer (TPE), polyvinyl chloride (PVC), neoprene, textured fabrics, or any other suitable material from the art, may be used to create the non-slip layer 42. It should be understood that the choice of material for the non-slip layer 42 may depend on factors such as the desired level of grip, durability, and compatibility with different workout surfaces.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pillow for neck and head support with a non-slip surface, comprising:

a) said pillow having a top surface with an indentation contoured to conform to the natural curves of a user's head and neck, said indentation being centrally located and surrounded by lateral sides extending upwardly to a predetermined height configured to partially surround the user's head and neck for enhanced stability during fitness activities; wherein each lateral side has a straight inner face that is perpendicular to said indentation, wherein a bottom edge of each straight inner face has an U-shape that contours to a curvature of said indentation; wherein each lateral side has a top portion with a substantially elongated oval shape, wherein each lateral side has a truncated apex centrally formed on said top portion, wherein each truncated apex has an oval shape; wherein said pillow further includes protrusions extending downwardly from each lateral side, wherein each protrusion tapers from a front side of the pillow towards a rear side thereof;

b) a grip assembly including said non-slip layer disposed on a bottom side of the pillow, said non-slip layer covering the entire bottom side and configured to provide traction to prevent movement of the pillow during dynamic exercises; wherein a core material is disposed between said top surface and said non-slip layer, said core material being a closed-cell PVC foam;

c) said top surface being non-porous and sealed to prevent absorption of sweat and facilitate cleaning.

2. The pillow for neck and head support with a non-slip surface set forth in claim 1, wherein the pillow further includes a core material disposed therebetween said top surface and said non-slip layer.

3. The pillow for neck and head support with a non-slip surface set forth in claim 1, wherein said indentation on the top surface is contoured to conform to the natural curves of the head and neck to promote proper spinal alignment and reduce strain during fitness routines.

4. The pillow for neck and head support with a non-slip surface set forth in claim 1, wherein said non-slip layer of the grip assembly comprises a rubber material configured to enhance friction and maintain stability on various workout surfaces.

5. The pillow for neck and head support with a non-slip surface set forth in claim 1, wherein an indentation is formed on said top surface.

6. A rectangular pillow with rounded corners for neck and head support with a non-slip surface, consisting of:

a) a core material being a closed-cell PVC foam;

b) a top surface having a centrally located indentation with curved transitions configured to conform to the natural curves of a user's head and neck, said indentation surrounded by lateral sides extending upwardly to a predetermined height configured to partially surround the user's head and neck, said top surface being nonporous and sealed to prevent absorption of sweat and facilitate cleaning; wherein each lateral side has a straight inner face that is perpendicular to said indentation, wherein a bottom edge of each straight inner face has an U-shape that contours to a curvature of said indentation; wherein each lateral side has a top portion with a substantially elongated oval shape, wherein each lateral side has a truncated apex centrally formed on said top portion, wherein each truncated apex has an oval shape; wherein said pillow further includes stepped protrusions extending downwardly from each lateral side, wherein width-wise each stepped protrusion comprises a plurality of tiers, each successive tier being recessed inwardly toward a central axis of the pillow and having a reduced width relative to an adjacent tier closer to an edge of the pillow, and wherein length-wise each protrusion tapers from a front side of the pillow towards a rear side thereof;

c) a grip assembly consisting of a non-slip layer made of rubber material covering the entire bottom side of the pillow and configured to provide traction to prevent movement during dynamic exercises.

7. A pillow for neck and head support with a non-slip surface, comprising:

a) said pillow being formed by a core material, said core material being a high-performance, closed-cell PVC foam exhibiting high strength and stiffness, a top surface having a central indentation surrounded by lateral sides, wherein said pillow and lateral sides have a predetermined height to promote proper spinal alignment and reduce strain during fitness activities; wherein each lateral side has a straight inner face that is perpendicular to said indentation, wherein a bottom edge of each straight inner face has an U-shape that contours to a curvature of said indentation; wherein each lateral side has a top portion with a substantially elongated oval shape, wherein each lateral side has a truncated apex centrally formed on said top portion, wherein each truncated apex has an oval shape; wherein said pillow further includes protrusions extending downwardly from each lateral side, wherein each protrusion tapers from a front side of the pillow towards a rear side thereof;

b) a grip assembly including said non-slip layer disposed on a bottom side of the pillow, said non-slip layer comprises a rubber material covering the entire bottom side and configured to provide traction to prevent movement during dynamic exercises;

c) said top surface being non-porous and sealed for easy cleaning and preventing the absorption of liquids or debris.

* * * * *